US010281223B2

(12) United States Patent
Hofmann et al.

(10) Patent No.: US 10,281,223 B2
(45) Date of Patent: May 7, 2019

(54) HEAT EXCHANGER

(71) Applicant: Mahle Behr GmbH & Co. KG, Stuttgart (DE)

(72) Inventors: Herbert Hofmann, Stuttgart (DE); Dieter Reisinger, Vaihingen/Enz (DE); Christian Wagner, Stuttgart (DE)

(73) Assignee: Mahle Behr GmbH & Co. KG (DE)

( * ) Notice: Subject to any disclaimer, the term of this patent is extended or adjusted under 35 U.S.C. 154(b) by 793 days.

(21) Appl. No.: 14/625,615

(22) Filed: Feb. 18, 2015

(65) Prior Publication Data

US 2015/0300758 A1 Oct. 22, 2015

(30) Foreign Application Priority Data

Feb. 19, 2014 (DE) ..... 10 2014 203 038

(51) Int. Cl.
*F28F 9/02* (2006.01)
*F28D 1/053* (2006.01)

(52) U.S. Cl.
CPC ..... *F28F 9/0224* (2013.01); *F28D 1/05391* (2013.01); *F28F 9/0278* (2013.01)

(58) Field of Classification Search
CPC ..... F28F 9/0221; F28F 9/0224; F28F 9/0278; F28D 1/05341; F28D 1/05391
USPC ..... 165/174–176
See application file for complete search history.

(56) References Cited

U.S. PATENT DOCUMENTS 5,205,347 A * 4/1993 Hughes ..... F28F 9/0278 165/174
6,827,139 B2 * 12/2004 Kawakubo ..... F28F 9/0278 165/174
7,318,470 B2 1/2008 Demuth et al.
7,481,266 B2 * 1/2009 Demuth ..... F28F 9/0278 165/175

(Continued)

FOREIGN PATENT DOCUMENTS

DE 10260030 A1 7/2003
DE 20307881 U1 9/2004

(Continued)

OTHER PUBLICATIONS

English abstract for EP-1798506.

(Continued)

*Primary Examiner* — Leonard R Leo
(74) *Attorney, Agent, or Firm* — Fishman Stewart PLLC

(57) ABSTRACT

A heat exchanger may include a heat exchanger block that may have a plurality of pipes and at least one collector. The at least one collector may include at least one pipe end that may accommodate the plurality of pipes in a leakproof manner at a longitudinal end thereof. The heat exchanger may include a terminal piece that may have a duct structure. The duct structure may include a plurality of webs that may separate a plurality of ducts situated between the plurality of webs from each other. The plurality of webs may include a web width $b_S$ of 1.0 mm<$b_S$<5.0 mm. The plurality of webs may define a ratio between the web width $b_S$ and a duct width $b_K$ may be of $b_S/b_K$<4.

16 Claims, 2 Drawing Sheets

(56) References Cited

U.S. PATENT DOCUMENTS

| | | | | |
|---|---|---|---|---|
| 7,571,761 | B2 | 8/2009 | Katoh et al. | |
| 7,604,044 | B2 * | 10/2009 | Kawakubo | F28F 9/0278 165/175 |
| 7,866,305 | B2 | 1/2011 | Geskes et al. | |
| 2007/0056720 | A1 * | 3/2007 | Demuth | F28F 9/0278 165/158 |
| 2007/0251682 | A1 * | 11/2007 | Sasaki | F28D 1/0391 165/153 |

FOREIGN PATENT DOCUMENTS

| | | | | |
|---|---|---|---|---|
| DE | 102005029171 | A1 | 2/2006 | |
| DE | 102006046671 | A1 | 4/2008 | |
| DE | 102008014373 | A1 | 9/2008 | |
| EP | 0634615 | A1 | 1/1995 | |
| EP | 1717530 | A2 * | 11/2006 | F25B 39/028 |
| EP | 1798506 | A2 | 6/2007 | |
| EP | 2372283 | A1 | 10/2011 | |
| JP | 2009041797 | A * | 2/2009 | F28D 1/05383 |
| WO | WO-2006/015029 | A2 | 2/2006 | |

OTHER PUBLICATIONS

English abstract for DE-20307881.
English abstract for DE-102006046671.
German Search Report for DE-102014203038.2, dated Mar. 28, 2014.

* cited by examiner

HEAT EXCHANGER

CROSS-REFERENCE TO RELATED APPLICATIONS

This application claims priority to German Patent Application No. 10 2014 203 038.2, filed Feb. 19, 2014, the contents of which are hereby incorporated by reference in their entirety.

TECHNICAL FIELD

The present invention relates to a heat exchanger having a heat exchanger block.

BACKGROUND

A generic heat exchanger having a heat exchanger block is known from WO 2005/038375 A1, wherein the heat exchanger block has a plurality of pipes and at least one collector, which comprises at least one pipe end, in which the pipes are accommodated in a leakproof manner at the longitudinal ends. A terminal piece having a duct structure is likewise provided, wherein said duct structure has symmetrical webs, which separate ducts situated therebetween from each other.

DE 102 60 030 A1 discloses a further heat exchanger having pipes and at least one terminal piece, which has a pipe end comprising an end plate, a baffle plate and a covering plate. This should provide a heat exchanger with which a simple and lightweight construction and where necessary a uniform distribution of a medium to a plurality of flow paths and/or a pressure-stable construction of the heat exchanger can be realised.

For $CO_2$ gas coolers, a new design for a coolant collector in the region of a terminal piece is generally needed owing to the high pressures occurring in said coolers. A plate design is particularly suitable. To achieve good coolant distribution, a duct with a large distribution area is needed. However, to be able to withstand high operating pressures, small ducts are required. For this reason, a compromise must be found between good coolant distribution and sufficient strength.

SUMMARY

The present invention is therefore concerned with the problem of specifying an alternative or improved embodiment for a generic heat exchanger that allows both improved strength and optimised coolant distribution.

This problem is solved according to the invention by the subject matter of the independent claims. Advantageous embodiments form the subject matter of the dependent claims.

The present invention is based on the general concept of providing an optimised duct structure in a terminal piece of a heat exchanger, said duct structure allowing both increased burst pressure resistance and optimised coolant distribution owing to its geometrical conditions and properties. The heat exchanger according to the invention has a heat exchanger block having a plurality of pipes and at least one collector, which has at least one pipe end, in which the pipes are accommodated in a leakproof manner at the longitudinal ends. A terminal piece having a duct structure is likewise provided, said duct structure having symmetrical webs, which separate ducts situated therebetween from each other. The exact geometrical configuration of said duct structure is then responsible for the advantages of the heat exchanger according to the invention. To this end, a web width is 1 mm$<b_S<$5 mm, preferably even 1 mm$<b_S<$3 mm, a ratio between the web width and a duct width is $b_S/b_K<4.0$, preferably even $b_S/b_K<2.5$, and likewise preferably a ratio between a web length and the web width is $l_S/b_S>4.5$. With webs formed in this manner and such a duct structure, an optimal compromise can be found between sufficient pressure resistance (many connection points and the smallest possible ducts) and optimised coolant distribution, in this case the webs having particular significance, since the terminal piece is connected to the pipe end in a materially cohesive manner by means of said webs.

In an advantageous development of the solution according to the invention, a ratio between the web width $b_S$ and a web height is $h_S<1.5$, in particular $<1.0$. This ratio should ensure that the terminal piece can be produced as an inexpensive but high-quality stamped or punched sheet metal part.

The terminal piece is expediently formed in several parts, namely a cover element and a first spacer element, the duct structure being situated in the spacer element. Purely theoretically, it is of course also conceivable for the terminal piece to be formed in one part, in this case the individual geometric dimensions of the webs of the duct structure being stamped into the terminal piece by means of a suitable stamping method. However, the multi-part configuration is particularly advantageous in comparison to this, since the comparatively complex and geometrically precise duct structure can be introduced into the first spacer element by means of a stamping or punching process and then said spacer element can be connected, in particular soldered, in an leakproof manner to the cover element and to the pipe end. Soldering takes place both at the edges of and along the webs. The multi-part configuration of the terminal piece thereby allows improved manufacturing quality and also a flexible construction, since in this case it is also conceivable for the cover element to be combined with different spacer elements or for the spacer element to be combined with different cover elements.

Three chambers for collecting or distributing coolant are provided in the first spacer element, two chambers being connected to each other in a communicating manner. A first spacer element configured in this manner is particularly suitable for use in a triple pass heat exchanger, in which a coolant inlet is arranged on one side and a coolant outlet is arranged on the opposite side of the heat exchanger. The coolant first flows via the cover element into the first chamber of the spacer element, in which it is distributed optimally by means of the duct structure to a first number of pipes, in particular flat pipes, of the heat exchanger block. After flowing through said flat pipes, the coolant exits the flat pipes at the opposite longitudinal end of same and is deflected by 180° via two chambers, which are connected to each other, of the first spacer element arranged there, in order to flow through a second number of flat pipes in the opposite direction. If the coolant is then arranged on the input side of the first spacer element again, it enters the second chamber of the first spacer element, from where it is conducted directly into the third chamber. From the third chamber, it flows through a further number of flat pipes, in order to be discharged via a corresponding third chamber in the opposite first spacer element. Of course, the first spacer element can also have more chambers, as a result of which a heat exchanger with not just three passes, but for example five or more passes, can be created. Purely theoretically, the provision of only one chamber is also conceivable, which produces a single pass heat exchanger.

In a further advantageous development of the solution according to the invention, a second spacer element is arranged between the first spacer element and the cover element, said second spacer element likewise having a duct structure with which the coolant can be distributed uniformly to a first chamber of the first spacer element and wherein said first chamber is connected to a number of flat pipes in a communicating manner via the pipe end. In this case, the individual chambers for collecting and distributing the coolant are not arranged in the first spacer element, but in the second spacer element. The best distribution of the coolant is usually achieved if the webs are arranged symmetrically around the centre axis of the collector inside a chamber, that is, inside a chamber of the first or second spacer element. However, a point-symmetrical arrangement of the individual webs about the centre point of an individual chamber can also be advantageous.

The supply of coolant into the collector can be implemented by a wide variety of variants. For instance, the coolant can be supplied and discharged by a pipe neck in each case, in this case the distribution of the coolant being carried out over the height and width of the respective spacer element. Alternatively, distribution can of course be implemented over the height by means of a profiled pipe, which can for example be realised as a D-profile pipe. Such a profiled pipe is mounted onto the terminal piece in a materially cohesive manner, the supply of coolant then being achieved via a number of aligning bores in the cover element and terminal piece. Alternatively, a duct structure can of course be stamped into the cover element, said duct structure undertaking the coolant supply and being connected in a communicating manner to a flange or pipe neck.

Further important features and advantages of the invention can be found in the subclaims, the drawings and the associated description of the figures using the drawings.

It is self-evident that the above-mentioned features and those still to be explained below can be used not only in the combination given in each case but also in other combinations or alone without departing from the scope of the present invention.

Preferred exemplary embodiments of the invention are shown in the drawings and are explained in more detail in the description below, the same reference symbols referring to the same or similar or functionally equivalent components.

BRIEF DESCRIPTION OF THE DRAWINGS

In the figures.

DETAILED DESCRIPTION

Figure 1:
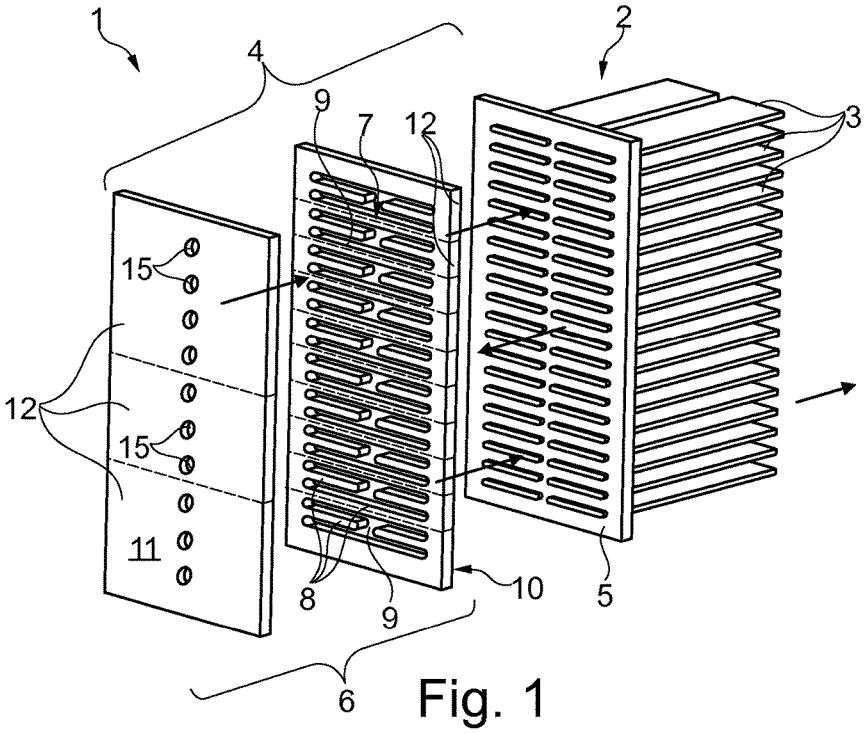
FIG. 1 schematically shows a heat exchanger according to the invention in an exploded diagram, FIG. 2 schematically shows a diagram as in FIG. 1, but with two spacer elements, FIG. 3 schematically shows a diagram as in FIG. 1, but with a differently configured spacer element, FIG. 4A through C schematically show different possibilities for connected profiled pipes to the respective collectors.

According to FIGS. 1 to 4, a heat exchanger 1 according to the invention, which can be configured for example as a $CO_2$ gas cooler, evaporator or condenser, has a heat exchanger block 2 with a plurality of pipes 3, in particular flat pipes, and at least one collector 4. The collector 4 has a pipe end 5, in which the pipes 3 are arranged in a leakproof manner at the longitudinal ends. Likewise provided is a terminal piece 6, which has at least one duct structure 7. The duct structure 7 in turn has symmetrical webs 8, which separate ducts 9 situated therebetween from each other. In order to be able to achieve the most optimal possible distribution of the coolant flowing through the collector 4 and the heat exchanger block 2, but also to ensure the necessary burst pressure resistance, in particular in $CO_2$ coolers, the geometric parameters in the region of the terminal piece 6 are defined as follows:

A web width $b_S$ (cf. FIG. 3) is between 1 and 3 mm. A ratio between the web width $b_S$ and a duct width $b_K$ is less than 4.0, preferably less than 2.5, and a ratio between a web length $l_S$ and the web width $b_S$ is greater than 4.5.

By the selection of the ratio between the web width $b_S$ and a web height $h_S$ of greater than 1.0, it can furthermore be ensured that in particular a first spacer element 10 that contains the duct structure 7 can be punched or stamped in a simple yet high-quality manner.

Figure 2:
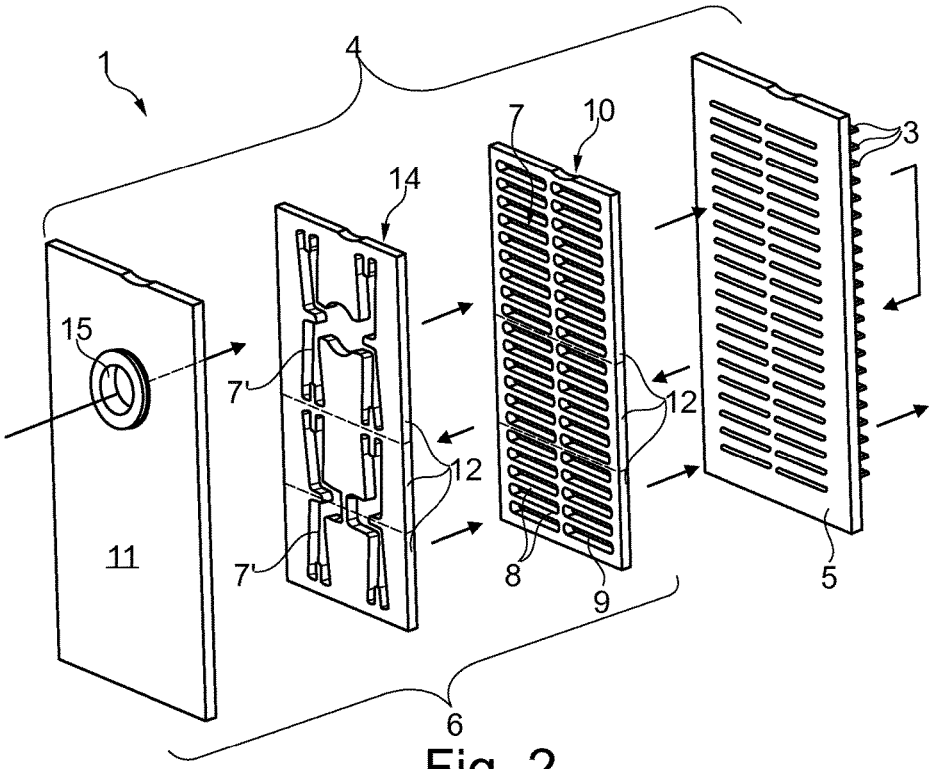
Figure 3:
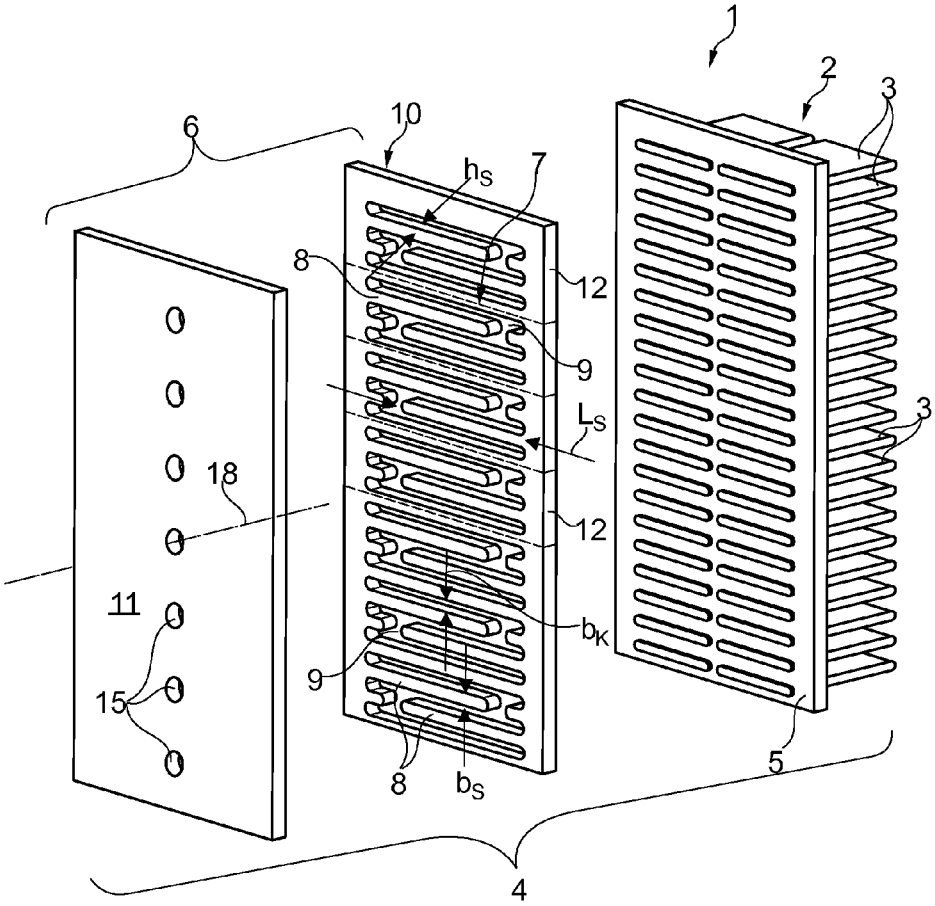

If FIGS. 1 to 4 are viewed, it can be seen that the terminal piece 6 is formed of several parts, namely a cover element 11 and the above-mentioned first spacer element 10, in this case the duct structure 7 according to the invention being situated in the first spacer element 10. At least three chambers 12 for collecting or distributing coolant can be provided in the cover element 11 or in the first spacer element 10, of which two chambers 12 are connected to each other in a communicating manner. For example, a triple pass heat exchanger 1 can be created thereby, in which a supply of coolant takes place on one side and a discharge takes place on the other, opposite side of the heat exchanger 1. Three ways of distributing the coolant to the individual chambers 12 can be distinguished, namely with a direct connection inside the spacer 10, with a further spacer element 14 (FIG. 2), or with a profiled pipe 13 (FIG. 1 or 3).

Alternatively to the embodiments shown in FIGS. 1 and 3, the embodiment of the heat exchanger 1 shown in FIG. 2 is also conceivable, in which a second spacer element 14 is arranged between the first spacer element 10 and the cover element 11. In this case the second spacer element 14 has a duct structure 7', by means of which the coolant is distributed uniformly to a first chamber 12 of the first spacer element 10, the first chamber 12 being connected to a number of flat pipes or pipes 3 in a communicating manner via the pipe end 5.

The pipe end 5 and the terminal piece 6, that is for example the first spacer element 10 and the cover element 11 and where applicable the second spacer element 14 are connected to each other in a leakproof manner, in particular soldered to each other in a fluid-tight manner, at the edges and by means of the webs 8.

Figures 4A, 4B, 4C:
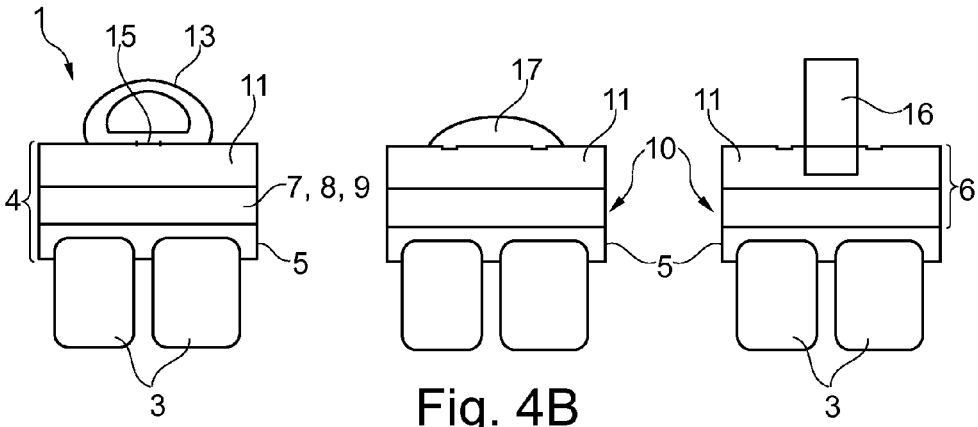

In the cover element 11 itself, at least one through-opening 15 is arranged (cf. FIG. 2), via which the collector 4 is supplied with coolant by means of a pipe neck 16 connected thereto (cf. FIG. 4*c*). Alternatively thereto, a plurality of through-openings 15 can be provided in the cover element 11 (cf. FIGS. 1 and 3), a profiled pipe 13 being provided, which covers at least some of the through-opening 15 and supplies it with coolant. Of course, it is also conceivable with a single pass heat exchanger 1 that the profiled pipe 13 covers all the through-openings 15 and thereby effects a comparatively uniform loading of the terminal piece 6 with coolant. Alternatively to the profiled pipe 13 or pipe neck 16, a bead 17 can also be provided in the cover element 11, which acts as a coolant line and supplies the collector 4 with coolant. Such a bead is for example shown in FIG. 4*b*.

If, for example, the terminal piece 6 is produced from a plurality of individual components 10, 11 and 14, it can be sensible with regard to improved standardisation to make these all the same thickness. However, purely in terms of flow, it makes sense to make them with different thicknesses. The individual elements 10, 14 can be produced by means of punching or milling and then preassembled or fixed to each other by a materially cohesive method (soldering/welding/adhesive bonding).

The configuration according to the invention of the terminal piece 6 and of the entire collector 4 allows an optimal distribution of the coolant to be achieved and at the same time the burst pressure resistance of the collector 4 to be greatly increased owing to the selected geometry of the webs 8 and ducts 9. An optimal distribution of the coolant can be achieved in particular if the webs 8 are arranged symmetrically around the centre axis 18 of the collector 4 inside a chamber 12 (cf. FIGS. 1 and 2) or else point-symmetrically around the centre point of an individual chamber 12 (cf. FIG. 3).

In general, the heat exchanger 1 according to the invention can be applied to virtually all heat exchanger applications, the advantages being particularly clear in the case of gas coolers and heat pump heaters and indirect evaporators/chillers.

The standardised configuration, in particular of the first and second spacer element 10, 14, means that cost-effective manufacturing of the heat exchanger 1 can also be realised, since in particular the complicated milled part that was previously provided in this region can be replaced.

The invention claimed is:

1. A heat exchanger, comprising:

a heat exchanger block including a plurality of pipes and at least one collector, the at least one collector including at least one pipe end accommodating the plurality of pipes in a leakproof manner at a longitudinal end thereof, a terminal piece, which has a duct structure, the terminal piece including a cover element and a first spacer element, wherein the duct structure includes a plurality of webs and a plurality of ducts each having at least one of the plurality of webs extending therein such that each duct is in fluid communication with more than one pipe from or to which each duct collects or distributes coolant, at least one other of the plurality of webs separating adjacent ducts from each other, wherein the plurality of webs include a web width $b_S$ of $1.0\ mm<b_S<5.0\ mm$, and the plurality of webs define a ratio between the web width $b_S$ and a duct width $b_K$ of $b_S/b_K<4$, and wherein the terminal piece includes at least three chambers provided in the first spacer element, each chamber having a plurality of the ducts, the chambers alternating from an adjacent chamber between distributing coolant to the pipes and collecting coolant from the pipes via the plurality of the ducts.

2. The heat exchanger according to claim 1, wherein:

the web width of the plurality of webs is $1.0\ mm<b_S<3.0\ mm$, and the ratio between the web width $b_S$ and the duct width $b_K$ is $b_S/b_K<2.5$.

3. The heat exchanger according to claim 2, wherein the plurality of webs are arranged symmetrically in the duct structure.

4. The heat exchanger according to claim 2, wherein the plurality of webs define a ratio between a web length $l_S$ and the web width $b_S$ of $l_S/b_S>4.5$, and a ratio between the web width $b_S$ and a web height $h_S$ of $b_S/h_S<1.5$.

5. The heat exchanger according to claim 1, wherein the plurality of webs define:

a ratio between a web length $l_S$ and the web width $b_S$ of $l_S/b_S>4.5$, and a ratio between the web width $b_S$ and a web height $h_S$ of $b_S/h_S<1.5$.

6. The heat exchanger according to claim 5, wherein the ratio between the web width $b_S$ and the web height $h_S$ is $b_S/h_S<1.0$.

7. The heat exchanger according to claim 1, wherein one of:

the terminal piece is formed in one piece, wherein the cover element is formed in one piece with the first spacer element, or the terminal piece is composed of a plurality of parts including the cover element and the first spacer element, which is separate from the cover element, wherein the duct structure is disposed in the first spacer element.

8. The heat exchanger according to claim 7, wherein at least one of:

the first spacer element includes a chamber for at least one of collecting and distributing a coolant, and the first spacer element includes a plurality of chambers for at least one of collecting and distributing a coolant, wherein at least two chambers of the plurality of chambers are connected to each other in a communicating manner.

9. The heat exchanger according to claim 7, wherein at least one of:

the cover element includes at least one through-opening, via which the collector is supplied with coolant, wherein the at least one through-opening is covered by a profiled pipe configured to supply the at least one through-opening with the coolant, the cover element includes a single through-opening, via which the collector is supplied with the coolant via a pipe neck connected thereto, and the cover element has a bead, the bead configured as a coolant line and supplies the collector with the coolant.

10. The heat exchanger according to claim 1, wherein the at least one pipe end and the terminal piece are connected to each other in a leakproof manner via the plurality webs of the duct structure and at a plurality of respective edges.

11. The heat exchanger according to claim 1, wherein the heat exchanger is configured as at least one of a $CO_2$ gas cooler, an evaporator and a condenser.

12. The heat exchanger according to claim 1, wherein the plurality of webs are arranged symmetrically in the duct structure.

13. The heat exchanger according to claim 1, wherein the terminal piece includes a cover element and a first spacer element, wherein the duct structure is disposed in the first spacer element.

14. The heat exchanger according to claim 13, wherein the first spacer element includes at least one chamber for at least one of collecting and distributing a coolant.

15. The heat exchanger according to claim 1, wherein each duct is in fluid communication with at least two pipes in a lateral direction and at least two pipes in a longitudinal direction.

16. A heat exchanger, comprising:

a heat exchanger block including a plurality of pipes and at least one collector, the at least one collector include at least one pipe end accommodating the plurality of pipes at a longitudinal end thereof;

a terminal piece including a cover element and a first spacer element, the first spacer element including a duct structure, wherein the duct structure has a plurality of webs arranged symmetrically on the first spacer element and a plurality of ducts each having at least one of the plurality of webs extending therein such that each duct is in fluid communication with more than one pipe from or to which each duct collects or distributes coolant, at least one other of the plurality of webs separating adjacent ducts from each other;

wherein the plurality of webs define:

a web width $b_S$ of 1.0 mm$<b_S<$5.0 mm;

a ratio between the web width $b_S$ and a duct width $b_K$ of $b_S/b_K<4$;

a ratio between a web length $l_S$ and the web width $b_S$ of $l_S/b_S>4.5$; and a ratio between the web width $b_S$ and a web height $h_S$ of $b_S/h_S<1.5$;

wherein the terminal piece includes at least three chambers provided in the first spacer element, each chamber having a plurality of the ducts, the chambers alternating from an adjacent chamber between distributing coolant to the pipes and collecting coolant from the pipes via the plurality of the ducts.

* * * * *